United States Patent [19]

Zaleon

[11] 4,261,683

[45] Apr. 14, 1981

[54] PILL COUNTING TRAY

[76] Inventor: Philip Zaleon, 215 Hadden Rd., Syracuse, N.Y. 13214

[21] Appl. No.: 18,988

[22] Filed: Mar. 9, 1979

[51] Int. Cl.[3] ..... B07C 7/00

[52] U.S. Cl. ..... 414/675; 53/390; 133/8 R; 141/334; 206/0.84; 209/702; 220/22

[58] Field of Search ..... 209/702; 133/1 R, 8 R; 141/334, 247, 246; 220/22; 206/0.84; 414/787, 675; 53/390

[56] References Cited

U.S. PATENT DOCUMENTS

| | | | |
|---|---|---|---|
| 2,536,127 | 1/1951 | DePhilip | 414/675 |
| 3,150,785 | 9/1964 | Clasen | 133/8 R X |
| 3,255,894 | 6/1966 | Van Handel et al. | 414/675 |
| 3,848,395 | 11/1974 | Totten | 414/675 X |
| 4,063,645 | 12/1977 | Canterman et al. | 209/702 |

*Primary Examiner*—Frank E. Werner
*Attorney, Agent, or Firm*—Burns & Jenney

[57] ABSTRACT

A tray for counting a discrete number of pills or capsules from a bulk supply including a housing having a bottom wall, two vertical opposed sidewalls and a pair of arcuate-shaped end walls that are arranged to turn upwardly and inwardly from the bottom wall. A divider extends between the two sidewalls or the housing to separate it into two individual compartments. A horizontal platform is removably supported upon the top of the divider in contiguous relationship with the end walls to establish elongated entrances to each compartment therebetween. In operation a bulk supply of pills or capsules is deposited upon the platform and the desired amount counted out using a conventional spatula. The counted tablets are passed into the entrance of one compartment while the overage remaining on the platform is passed into the other thereby positively segregating the tablets. Pouring spouts are provided in each compartment to enable the counted tablets to be deposited into a prescription bottle and the overage to be returned to a bulk supply container.

12 Claims, 4 Drawing Figures

PILL COUNTING TRAY

BACKGROUND OF THE INVENTION

This invention relates to apparatus for dispensing a desired number of medicinal tablets such as pills and capsules and, in particular, to a counting tray for safely, hygenically and reliably enabling a desired number of medicinal tablets to be separated from a bulk supply and poured into a dispensing bottle.

The most pertinent prior art known to the applicant at the time of filling this application is embodied in U.S. Pat. Nos.: 3,255,894, 3,848,395, 3,402,827, 4,047,620, 3,662,904, 4,065,000.

The most widely used device employed by pharmacists for counting out pills and capsules, or more generally tablets, is a simple flat tray having a collecting bin positioned along one side margin thereof. A bulk supply of tablets is poured onto the tray and the desired amount counted into the bin using a conventional spatula technique. Once counted, the segregated tablets in the bin must be somehow placed in a prescription bottle without spilling the overage remaining on the tray. This oftentimes proves to be rather difficult. Although this type of tray is simple in construction and can be easily handled, the number of tablets that can be processed at one time is generally limited. Similarly, any moderate displacement of the tray can cause spillage or comingling of already separated tablets with the bulk.

To avoid some of the difficulties associated with the simple conventional tray, complex counting devices have been devised which use templets to mechanically count out a certain number of tablets. An overage of tablets is typically poured over the templet to insure that all the capture cells of the templet are filled before the unused tablets are removed from the apparatus. The templet is then repositioned in regard to a partition located thereunder whereupon the tablets captured in the cells are allowed to drop down into a collection bin from where they may be dispensed into a prescription bottle or the like. As can be seen, the capture cells of the templet must be specifically contoured to accept the size and shape of tablets in process thereby limiting the overall usefulness of the device. Oftentimes pills or capsules will become lodged between the close fitting moving components and break. This requires that the apparatus be cleaned which is a difficult and time consuming task. Because of the number and complexity of the parts involved, templet devices are inherently bulky and thus difficult to handle.

A different approach to the tablet or pill counting problem is presented in the above noted U.S. Pat. No. 3,255,894. The apparatus includes a housing having a collapsible platform that is arranged to part or split along its central axis. A supply of pills is placed on one side of the central parting line of the platform and the desired number of pills are counted out and placed on the other side of the line. An actuating means is then depressed causing the two sections of the platform to be tilted inwardly along the parting line whereupon each group of pills is deposited in a separate bin located under the platform. Pouring means are provided in each bin to enable the collected group of pills to be dispensed therefrom. Here again, the device is bulky and complex and requires the use of closely related coacting parts in order to properly carry out the desired operation. Accordingly, pills can become fouled in the moving parts and be broken. Once contaminated with broken pills or capsules, the complex mechanism becomes extremely difficult to clean. It is further noted that a special finger-mounted spatula is needed to properly count pills situated upon the platform of the housing which again limits the utility of the device.

SUMMARY OF THE INVENTION

It is therefore an object of the present invention to improve apparatus used for counting out and dispensing medicinal tablets.

Another object of the present invention to to eliminate the danger of unwanted spillage during the counting and dispensing of sanitary pills and capsules.

Yet another object of the present invention is to provide a pharmaceutical counting tray that has no moving parts and is yet able to positively segregate both counted medicinal tablets and the bulk overage into two individual enclosed chambers from which they can be safely and accurately poured into separate receptacles.

A further object of this invention is to avoid unwanted spillage and breakage of pills during the counting and dispensing thereof.

A still further object of the present invention is to provide an improved pill counting tray that is easy to handle and simple to clean.

Yet a still further object of the present invention is to provide a pill counting tray that is relatively inexpensive to manufacture.

These and other objects of the present invention are attained by means of a pill counting apparatus that includes a housing having a bottom wall, two vertical side walls and a pair of arcuate shaped end walls that turn upwardly and inwardly from the bottom wall. A divider, extending between the side walls, separates the housing into two compartments and a platform is seated over the divider that is in contiguous relation with the side walls of the housing and in non-contiguous relation with the end wall to establish an elongated entrance therebetween at each end of the housing through which pills situated upon the platform may be passed into the chambers below.

BRIEF DESCRIPTION OF THE DRAWINGS

For a better understanding of these and other objects of the present invention reference is had to the following detailed description of the present invention which is to be read in conjunction with the accompanying drawings, wherein.

DESCRIPTION OF THE INVENTION

Figure 1:
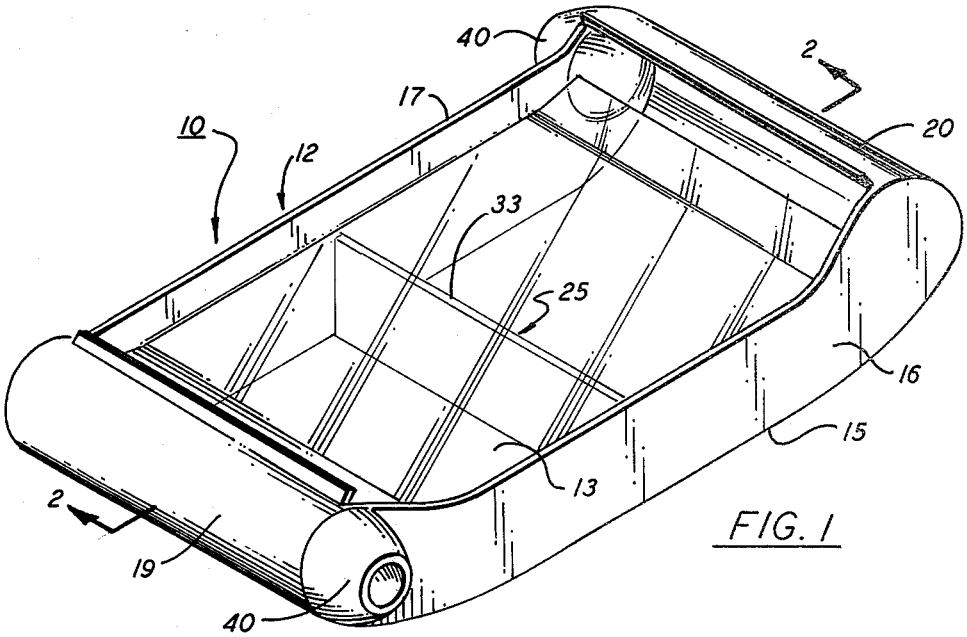
FIG. 1 is a perspective view of a pill counting tray embodying the teachings of the present invention.
Figure 2:
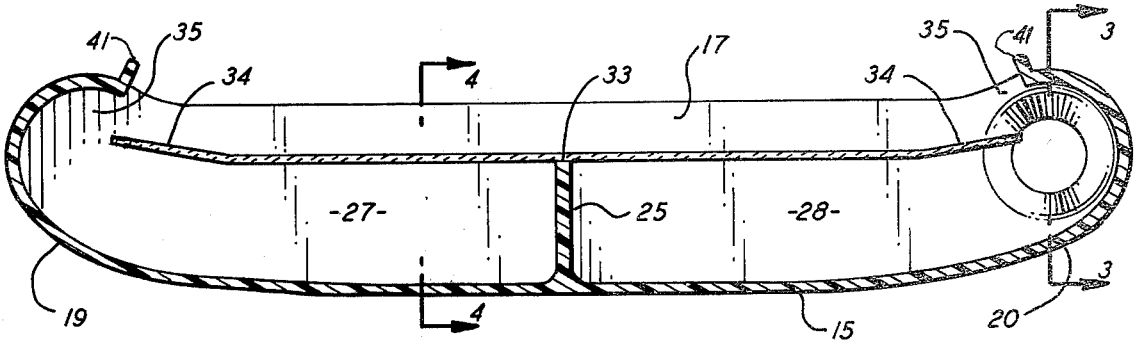
FIG. 2 is an enlarged side view in section showing the pill counting tray depicted in FIG. 1.

Referring now more closely to the drawings, the numeral 10 generally designates a pill counting device embodying the teachings of the present invention. The term pill will be herein used in the generic sense and its use is intended to cover any type of pills, capsules or tablets that are provided in bulk to doctors, pharmacists or the like and which therefore must be counted out prior to their being dispensed to a patient.

The pill counting device is made up of two main sections that includes an open topped housing 12 and a planar platform 13 which is capable of being easily snapped into a raised position within the housing. The housing is preferably molded from a single piece of resilient plastic that is able to withstand normal shocks and falls without breaking. All corners of the molded structure are smoothly merged together to provide a generous chamfer to prevent pills from being lodged between the cojoined walls and to facilitate cleaning of the housing.

The housing contains a generally rectangular flat bottom 15 and two vertical side walls which include a front wall 16 and a parallel rear wall 17. The two end walls 19 and 20 of the housing are generally arcuate in form and curve upwardly and inwardly from the bottom wall to create a scroll-like construction at both ends of the housing. The end sections of the side walls complement the geometry of the end walls to provide for an enclosed structure capable of supporting a relatively large quantity of pills therein.

A centrally located divider 25 rises vertically from the bottom wall of the housing and extends laterally across the housing between the side walls to separate the housing into two compartments 27 and 28. Although the compartments are illustrated as being of substantially equal size, it should be understood that one of the compartments may be made larger than the other by simply changing the longitudinal location of the divider. As will become apparent from the disclosure below, this may be of advantage when large quantities of pills are to be counted out and dispensed.

Figure 4:
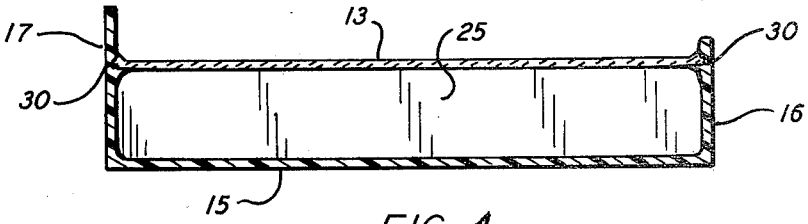
FIG. 4 is a section taken along lines 4—4 in FIG. 2 showing the comparative elevation of the two side walls of the housing and the manner in which a platform is supported therebetween.

The platform 13 is preferably constructed of a single sheet of clear plastic so that when it is positioned in the housing, a person using the device can see directly into each of the compartments. As best seen in FIG. 4, grooves 30—30 are provided in the inner surface of each side wall with the groove generally complimenting the cross-sectional configuration of the platform. The lateral width of the platform is slightly wider than that of the housing so that, in assembly, the side edges of the platform will slide snugly into the grooves. The plastic parts have sufficient resiliency to allow the platform to be easily snapped into and out of the housing so that the housing can be easily cleaned.

The top surface 33 of the divider is brought up to the lower edges of the two grooves whereby the divider acts as a stanchion to help support the central region of the platform. The two longitudinal edges 34—34 of the platform are brought under the top surfaces of the housing endwalls. Each longitudinal edge terminates some distance from the adjacent inside surface of the opposing endwall to create an elongated entrance 35—35 that opens into the chamber below. The two edges are inclined upwardly frm the substantially flat body of the platform and serve to prevent pills situated upon the platform from rolling or sliding into the entrances when the bottom of the tray is resting on a horizontal work table or the like.

Figure 3:
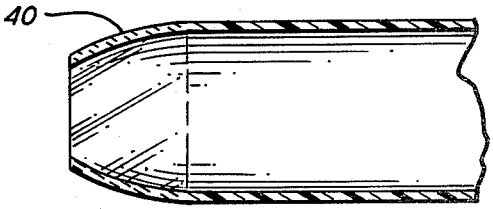
FIG. 3 is a section taken along lines 3—3 in FIG. 2 showing the construction of the pouring spouts provided in the side walls of the subject pill counting tray.

Each compartment is provided with a conical-shaped pouring spout 40—40 that is molded into the sidewall of the housing at the end section thereof and which compliments the shape of the endwall. In practice, each pouring spout extends outward from the housing to provide a funnel by which pills collected in the compartment may be dispensed into a receiving receptacle. As best illustrated in FIG. 3, the inside walls of the housing blend or smoothly merge into the funnel-like spout to provide a relatively uninterrupted flow channel through which the pills can flow in an unimpeded stream. In practice, the pouring spouts are situated in opposing sidewalls of the housing to prevent pills collected in one compartment from escaping as those collected in the other compartment are being emptied into an appropriate receiving receptacle. Preferably the spouts are formed of a transparent material to enable the user to monitor the flow of pills therethrough.

In operation, a bulk supply of pills to be dispensed is poured onto the platform. The desired number of pills is separated from the bulk supply using a conventional spatula. To facilitate spatula counting, the top surface of the frontwall 16 (FIG. 4) is brought to a height slightly higher than the top surface of the platform whereby the spatula can be easily moved to all regions of the platform to engage pills situated thereon. The rear wall 17 is brought to a higher elevation to prevent unwanted spillage thereover.

As the counted pills are separated from the bulk supply, the counted pills are pushed up the inclined edge of the platform and passed through one of the entrances into the compartment below. Upon completing the count, the overage remaining upon the platform is similarly passed into the other compartment. This can be rapidly achieved by simply tilting the housing up about its curved endwall and allowing the pills to slide through the appropriate entrance. Because the top surface of the endwall is brought over the edge of the platform, an enclosed chute-like passageway is established at the entrance to each compartment, preventing pills in transit from escaping from the housing. Raised lips 41—41 are also provided along the top edge of each endwall to further prevent loss of pills from the housing.

With the pills thus segregated in the two substantially enclosed compartments, each batch can be safely poured into an appropriate bottle through the associated pouring spout. Because of the contour of the tray, any overage of pills remaining on the platform can be poured into a bulk supply bottle by simply tipping the spout into the bottle opening. As can be seen, the pills on the platform will automatically slide through the entrance chute and be guided directly into the funnel of the pouring spout. This operation can be carried out swiftly using one hand thereby saving a good deal of time and effort on the part of the user.

While this invention has been described with reference to the structure disclosed herein, it is not confined to the details set forth and this application is intended to cover any modifications or changes as may come within the scope of the following claims.

I claim:

1. Apparatus for counting pills and capsules including a housing having a bottom wall with oppositely directed upwardly inclined portions, a pair of opposed parallel sidewalls and a pair of opposed arcuate-shaped end walls connected to said bottom wall that turn upwardly and inwardly from said bottom wall to form a semi-circular enclosure at both ends of the housing, a pouring spout connected to each enclosure and formed with its longitudinal axis perpendicular to one of the sidewalls, a divider extending across the housing between the two sidewalls to separate the housing into two compartments, a recessed platform having a continuous upper surface seated upon the divider that is in contiguous relation with said sidewalls of said housing and which passes into the semi-circular enclosures at both ends of the housing, said platform being in non-contiguous relation with said end walls to form an elongated entrance opening into each compartment whereby pills and capsules situated upon said platform are able to be passed therethrough into each of said compartments.

2. The apparatus of claim 1 wherein said platform is inclined upwardly toward each of said elongated entrances.

3. The apparatus of claim 1 wherein said pouring spout is contained in one side wall of each of said compartments.

4. The apparatus of claim 3 wherein said pouring spouts are each positioned adjacent to and in complimentary relationship with the arcuate shaped end walls of said housing.

5. The apparatus of claim 4 wherein said pouring spouts are each located in opposed side walls of the housing.

6. The apparatus of claim 3 wherein the spouts are formed of a transparent material.

7. The apparatus of claim 1 that further includes snap fastener means for removably mounting said platform within said housing in general parallel alignment with said bottom wall thereof.

8. The apparatus of claim 7 wherein the bottom wall of said housing merges smoothly with the side walls and the divider to prevent pills and capsules from being lodged therebetween.

9. The apparatus of claim 1 wherein the front side wall of said housing is slightly higher than the top surface of said platform whereby a counting spatula can be conveniently passed thereover to contact pills and capsules situated upon said platform.

10. The apparatus of claim 9 wherein the rear side wall of the housing is higher than said front wall to prevent pills and capsules situated upon said platform from passing thereover.

11. The apparatus of claim 1 wherein said divider is centrally positioned within said housing whereby each compartment is substantially the same size as the other.

12. The apparatus of claim 1 wherein said platform is formed of a transparent material.

* * * * *